United States Patent [19]

Scherenberg et al.

[11] 4,286,359

[45] Sep. 1, 1981

[54] PUSH BUTTON, ESPECIALLY FOR LOCKS OF SAFETY BELTS

[75] Inventors: Hans O. Scherenberg; Werner Breitschwerdt, both of Stuttgart; Wilhelm Klein, Aidlingen; Walter Jahn, Sindelfingen, all of Fed. Rep. of Germany

[73] Assignee: Daimler-Benz Aktiengesellschaft, Stuttgart, Fed. Rep. of Germany

[21] Appl. No.: 726,560

[22] Filed: Sep. 27, 1976

[30] Foreign Application Priority Data

Sep. 27, 1975 [DE] Fed. Rep. of Germany ..... 2543263

[51] Int. Cl.[3] ..... A44B 19/00; A47C 31/00

[52] U.S. Cl. ..... 24/230 R; 308/3 R

[58] Field of Search ..... 308/3 R, 3 CH; 24/230 A; 200/340, 159 R, 159 A, 159 B; 16/121

[56] References Cited

U.S. PATENT DOCUMENTS

| | | | |
|---|---|---|---|
| 2,841,031 | 7/1958 | Young et al. | 200/340 |
| 3,484,064 | 12/1969 | Koenig | 308/3 R |
| 3,728,764 | 4/1973 | Carter | 24/230 A |
| 3,995,914 | 12/1976 | Schardt et al. | 308/3 R |

*Primary Examiner*—Richard A. Bertsch

*Attorney, Agent, or Firm*—Craig and Antonelli

[57] ABSTRACT

A push button for locks of safety belts whose top side closes off flush with the housing receiving the same or is arranged recessed in the housing; the lateral guide surfaces of the push button and the corresponding guide surfaces in the lock housing are thereby provided with a large number of projecting and recessed areas.

6 Claims, 2 Drawing Figures

PUSH BUTTON, ESPECIALLY FOR LOCKS OF SAFETY BELTS

The present invention relates to a push button, especially for locks of safety belts, whose upper side closes off flush with the housing receiving the same or is arranged recessed in the housing.

With such types of belt locks, a certain gap between the lateral guide surfaces of the push button and the guide surfaces in the lock housing cooperating with the same must always be provided in order to assure an easy actuation of the push button. However, the disadvantage results therefrom with the push buttons used heretofore that the user during the actuation of the push button can get into this intermediate or clearance space with a fingernail and that the nail is damaged thereby.

The present invention is therefore concerned with the task to eliminate this disadvantage and to provide a push button of the aforementioned type in which, notwithstanding an ease of actuation, a damage or injury to a fingernail is no longer possible.

This is achieved according to the present invention in that the lateral guide surfaces of the push button and the corresponding guide surfaces in the lock housing are provided with a large number of complementary projecting and recessed areas.

According to the preferred embodiment of the present invention, the cooperating guide surfaces are constructed meander-shaped as viewed from above on the push button.

Accordingly, it is an object of the present invention to provide a push button, especially for locks of safety belts which avoids by simple means the aforementioned shortcomings and drawbacks encountered in the prior art.

Another object of the present invention resides in a push button for locks of safety belts which eliminates the danger of damage or injury to the fingernail of a user, yet does not impair the ease of operation and actuation thereof.

A further object of the present invention resides in a push button for locks of safety belts which is simple in construction and does not entail great expenditures in manufacture thereof yet avoids breakage of fingernails of the user when actuating the push button.

Figure 1:
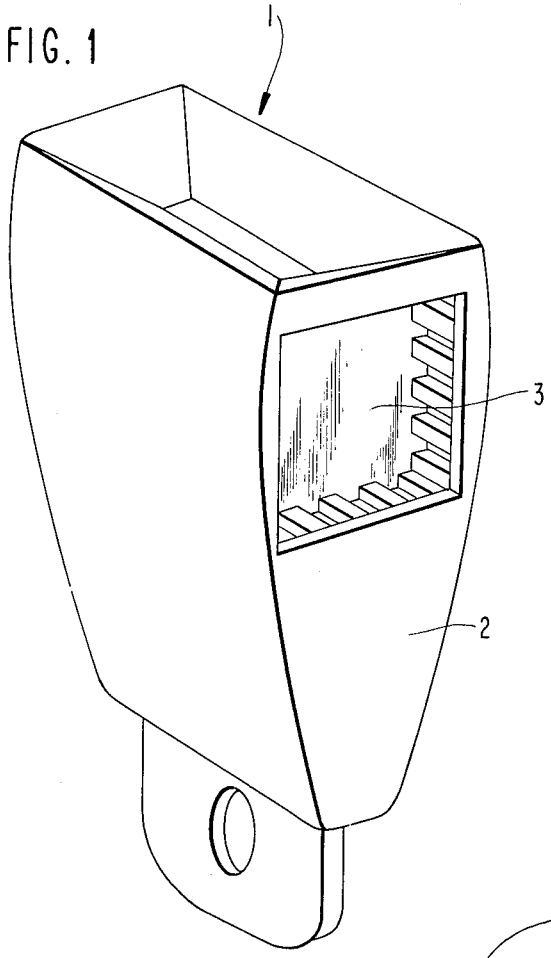
Figure 2:
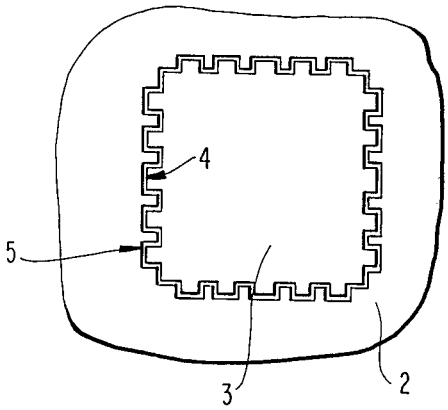

These and other objects, features and advantages of the present invention will become more apparent from the following description when taken in connection with the accompanying drawing which shows, for purposes of illustration only, one embodiment in accordance with the present invention, and wherein:

FIG. 1 is a perspective view of a safety belt lock with a push button in accordance with the present invention; and FIG. 2 is a partial plan view on a push button and the guide surfaces of the lock housing cooperating therewith in accordance with the present invention.

Referring now to the drawing wherein like reference numerals are used throughout the two views to designate like parts, in the lock for a safety belt (not shown) which is illustrated in the drawing and is generally designated in FIG. 1 by reference numeral 1, a push button 3 is arranged recessed in the lock housing 2. The cooperating lateral guide surfaces 4 and 5 of the push button 3 and of the lock housing 2 are thereby constructed meander-shaped—as viewed from above on the push button 3—whereby, however, also another construction, for example, an undulated construction would be quite feasible. It is only necessary to make sure that the individual projecting and recessed areas are narrower than the average width of a fingernail.

While we have shown and described only one embodiment in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. A push button for locks whose top side is at most flush with a housing of the lock receiving the same, characterized in that the lateral guide surfaces of the push button and the corresponding guide surfaces in the lock housing are non-circular in transverse cross-section and are provided with a large number of projecting and recessed areas which are sized to prevent access by a user's fingernail to a clearance space formed between said projecting and recessed areas.

2. A push button according to claim 1, characterized in that the guide surfaces are constructed meander-shaped.

3. A push button according to claim 2, characterized in that the push button is arranged recessed in the housing.

4. In a push button lock having a push button whose top side is at most flush with a housing of the lock receiving the same and which has a non-circular transverse cross-sectional shape, the improvement in that lateral guide surfaces of the push button and corresponding guide surfaces in the lock housing are provided with a large number of projecting and recessed areas which are sized to prevent access by a user's fingernail to a clearance space formed between said projecting and recessed areas.

5. A push button according to claim 4, characterized in that the lock is a lock for safety belts.

6. In a push button lock according to claim 4, the further improvement in that the guide surfaces are constructed meander-shaped.

* * * * *